US006116013A

United States Patent [19]

Moller

[11] Patent Number: 6,116,013

[45] Date of Patent: Sep. 12, 2000

[54] BOLTED GAS TURBINE COMBUSTOR TRANSITION COUPLING

[75] Inventor: Michael Scott Moller, Orlando, Fla.

[73] Assignee: Siemens Westinghouse Power Corporation, Orlando, Fla.

[21] Appl. No.: 09/002,545

[22] Filed: Jan. 2, 1998

[51] Int. Cl.[7] ..... F02B 7/20

[52] U.S. Cl. ..... 60/39.02; 60/39.32; 60/39.37

[58] Field of Search ..... 60/39.02, 39.31, 60/39.32, 39.37

[56] References Cited

U.S. PATENT DOCUMENTS

| | | | |
|---|---|---|---|
| 2,445,661 | 7/1948 | Constant et al. | 60/39.32 |
| 2,494,821 | 1/1950 | Lombard | 60/39.32 |
| 2,592,060 | 4/1952 | Oulianoff | 60/39.37 |
| 2,594,808 | 4/1952 | Rubbra | 60/39.37 |
| 2,608,057 | 8/1952 | Boyd | 60/39.37 |
| 2,615,300 | 10/1952 | Lombard | 60/39.32 |
| 2,968,924 | 1/1961 | Upton . | |
| 4,016,718 | 4/1977 | Lauck | 60/39.32 |
| 4,030,875 | 6/1977 | Grondahl et al. | 60/753 |
| 4,191,011 | 3/1980 | Sweeney et al. . | |
| 4,398,864 | 8/1983 | Camboulives et al. . | |
| 4,411,134 | 10/1983 | Moir | 60/39.31 |
| 5,419,114 | 5/1995 | Bauermeister et al. | 60/39.32 |
| 5,572,863 | 11/1996 | Wrightham et al. . | |

FOREIGN PATENT DOCUMENTS 0 561 434 A1 8/1993 European Pat. Off. .

*Primary Examiner*—Ted Kim

*Attorney, Agent, or Firm*—Eckert Seamans Cherin & Mellott, LLC

[57] ABSTRACT

A coupling apparatus for connecting a combustor to a transition in a gas turbine is provided. The coupling apparatus comprises a transition cylinder attached to the discharge end of the combustor, a cylinder flange formed on the downstream end of the transition cylinder, a transition having an upstream end on which a transition flange is formed, and a plurality of nut and bolt combinations circumferentially spaced about the periphery of the flanges for maintaining the transition cylinder in tight engagement with the transition when the cylinder flange mates with the transition flange. In a preferred embodiment, the cylinder flange further comprises a spigot lip and the transition flange further comprises a recess for receiving the spigot lip so as to effect a tight spigot fit when the cylinder flange mates with the transition flange.

4 Claims, 3 Drawing Sheets

BOLTED GAS TURBINE COMBUSTOR TRANSITION COUPLING

FIELD OF THE INVENTION

The present invention relates generally to gas turbines, and more particularly to an apparatus and method for attaching a transition cylinder to a combustor transition.

BACKGROUND OF THE INVENTION

Gas turbines comprise a casing for housing a compressor section, combustion section and turbine section. The combustion section comprises an inlet end, a discharge end and a combustor transition. The transition, which is simply a duct, is proximate the discharge end of the combustion section and comprises a wall that defines a flow channel that directs the working fluid into the turbine inlet end.

A supply of air is compressed in the compressor section and directed into the combustion section. The compressed air enters the combustion inlet and is mixed with fuel. The air/fuel mixture is then combusted to produce high temperature and high pressure gas. This gas is then directed through the transition and into the turbine section, where it forms the turbine working fluid. The gas flows over the blades of the turbine, which causes the turbine rotor to drive a generator, thereby producing electricity.

As those skilled in the art are aware, the maximum power output of a gas turbine is achieved by heating the gas flowing through the combustion section to as high a temperature as is feasible. The hot gas, which is also at a high pressure, heats the various turbine components as it flows through the turbine. Accordingly, the ability to increase the combustion firing temperature is limited by the ability of the turbine components to withstand the increased temperature and pressure of the gas.

FIG. 1 shows a side view of a combustion section of a gas turbine. As is typical, the combustion section comprises a number of combustors (or combustion baskets) 10 in which the air/fuel mixture is burned. Shown in FIG. 2 is an exploded perspective view of the connection of the combustor basket 10 to the transition 30. The combustor basket 10 is connected to the transition 30 by means of a transition cylinder 20. The upstream end 22 of the cylinder 20 slides onto an outlet end 12 of the combustor basket 10 and the downstream end 28 of the cylinder 20 is mechanically coupled to an upstream end 32 of the transition 30.

The cylinder 20 directs the hot gas from the combustor basket 10 into the upstream end 32 of the transition 30 and is best viewed as an extension of the transition 20. The cylinder 20 serves as an aid in servicing the turbine. If one did not have some way of separating the transition 30 from the combustor basket 10 one would have to pull the basket 10 completely out of the turbine before removing the transition 30 for servicing. The cylinder 20 allows for removal of the transition 30 without removing the combustor basket 10.

One common technique of attaching the cylinder 10 to the transition 30 is to utilize a "V" band coupling 40. The area of concern to the present invention as highlighted in FIG. 1 is depicted in FIG. 3. As shown in FIG. 3, there are respective mating flanges 24 and 34 on the downstream end 28 of cylinder 20 and the upstream end 32 of the transition 30, over which the "V" band coupling 40 fits.

The "V" band coupling 40 comprises two semi-circular rings, each of which surround 180 degrees of the junction of the mating flanges 24 and 34. The rings of the "V" band coupling 40 are bolted together where the mating flanges 24 and 34 meet. This bolting mechanism is intended to clamp the "V" band coupling 40 radially inward around the respective mating flanges 24 and 34 of the cylinder 20 and the transition 30, thereby holding these parts in position while maintaining their integrity.

The "V" band coupling 40 technique, however, has several drawbacks. One such drawback is that the mating flanges 24 and 34 do not have a direct mechanical coupling to prevent fretting caused by the vibration forces of the combustor and the turbulent conditions of the gas exiting the combustor basket 10. As a result, the parts of the cylinder 20 and transition 30 that contact each other, i.e., the respective faces 25 and 35 of the mating flanges 24 and 34, are susceptible to such fretting.

Another drawback of the "V" band coupling 40 is that its clamping design is not strong enough for its intended purpose. The "V" band coupling 40 has been found to be too weak to withstand the forces caused by thermal expansion. As a result, the coupling 40 yields and becomes loose which causes fretting of the surfaces 25 and 35 of the mating flanges 24 and 34. It is, therefore, desirable to provide an apparatus for connecting a transition cylinder to a transition of a gas turbine that is more robust and is less susceptible to fretting than conventional apparatus.

SUMMARY OF THE INVENTION

A coupling apparatus for connecting a combustor to a transition in a gas turbine is provided. The coupling apparatus comprises a transition cylinder attached to the downstream end of the combustor, a cylinder flange formed on the downstream end of the transition cylinder, a transition having an upstream end on which a transition flange is formed, and a plurality of locking mechanisms for maintaining the transition cylinder in tight engagement with the transition when the cylinder flange mates with the transition flange.

The cylinder flange further comprises a plurality of cylinder bores formed therein which are axially oriented and circumferentially spaced about the cylinder flange. Similarly, the transition flange further comprises a plurality of transition bores formed therein which are axially oriented and circumferentially spaced about the transition flange. The respective bores of the cylinder flange and the transition flange line up so that the locking mechanisms extend through an alignment of the cylinder bores and the transition bores. Preferably, there are eight locking mechanisms, eight cylinder bores, and eight transition bores, all equally spaced about the periphery of the mating of the cylinder flange and the transition flange. More preferably, the locking mechanisms are nut and bolt combinations.

In a preferred embodiment, the cylinder flange further comprises a spigot lip and the transition flange further comprises a recess for receiving the spigot lip so as to effect a tight spigot fit when the cylinder flange mates with the transition flange. Alternatively, the transition flange further comprises a spigot lip while the cylinder flange further comprises a recess. The spigot lip and recess extend 360 degrees about the periphery of the mating of the cylinder flange and the transition flange.

DETAILED DESCRIPTION OF THE PREFERRED EMBODIMENTS

Figure 4:
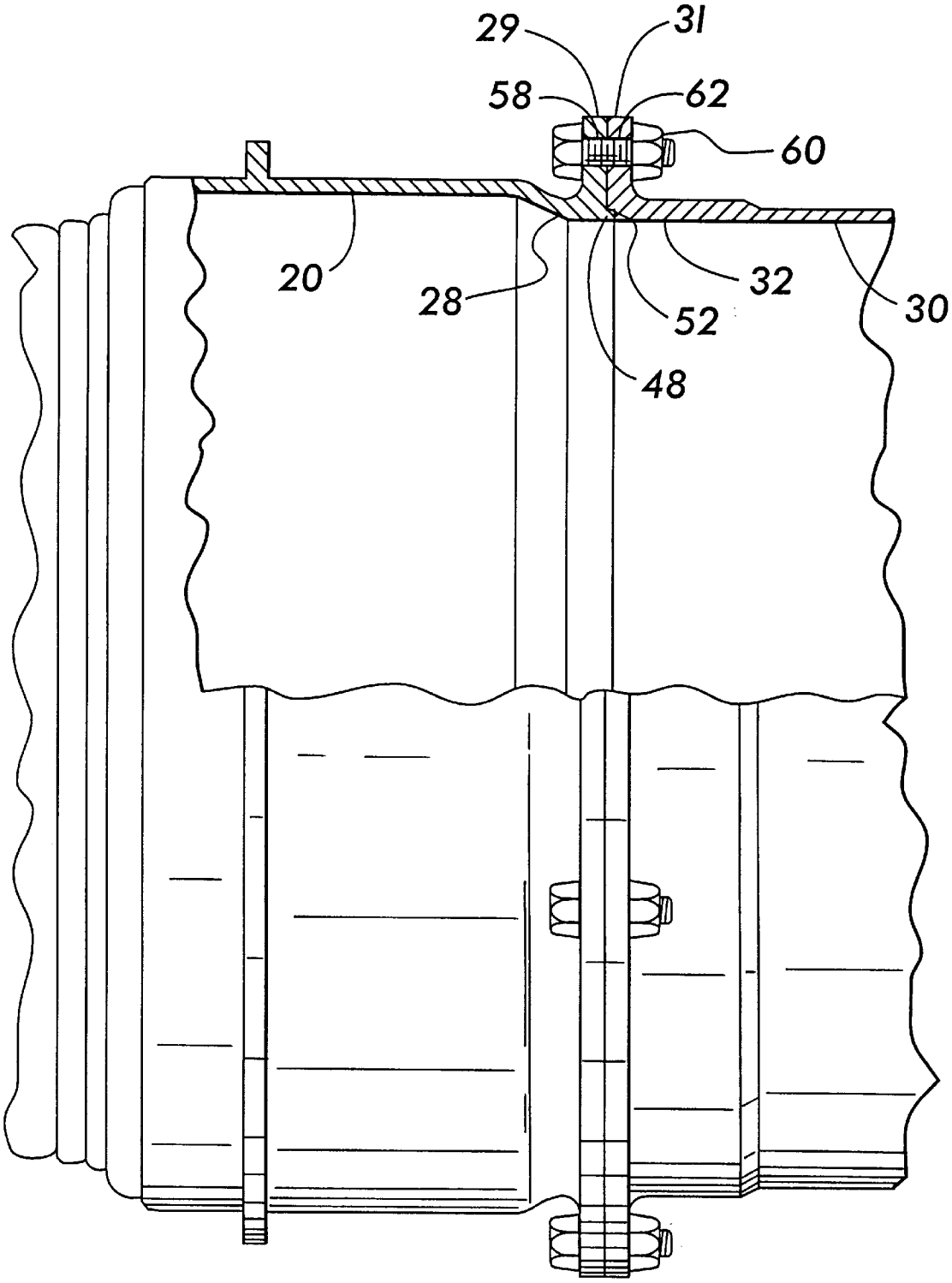
FIG. 4 a partial, cross-sectional view of the coupling apparatus according to the present invention.

Referring to the drawings, there is shown in FIG. 4 a partial, cross-sectional view of the coupling apparatus according to the present invention. The function of the coupling apparatus is to connect a transition cylinder 20 to a transition 30 of a gas turbine. The coupling comprises a transition cylinder 20 having a downstream end 28 with a cylinder flange 29 formed thereon, a transition 30 having an upstream end 32 with a transition flange 31 formed thereon, and a plurality of locking mechanisms 60 for maintaining the transition cylinder 20 in tight engagement with the transition 30 when the cylinder flange 29 mates with the transition flange 31. Preferably, the locking mechanisms 60 are nut and bolt combinations 60. Alternatively, the locking mechanisms can be screws or screw and nut combinations.

The cylinder flange 29 further comprises a plurality of cylinder bores 58 formed therein which are axially oriented and circumferentially spaced about the cylinder flange 29. The transition flange 31 further comprises a plurality of transition bores 62 formed therein which are axially oriented and circumferentially spaced about the transition flange 31. The respective bores 58 and 62 of the cylinder flange 29 and the transition flange 31 line up so that the locking mechanisms 60 extend through an alignment of the cylinder bores 58 and the transition bores 62.

Although any practical number will work, preferably, there are eight locking mechanisms 60, eight cylinder bores 58, and eight transition bores 62, all equally spaced about the periphery of the mating of the cylinder flange 29 and the transition flange 31. For example, as few as four and as many as twelve combinations of the foregoing have been tested to work adequately. In the embodiment of the invention with screws serving as the locking mechanisms 60, the bores 58 and 62 are threaded to receive the screws.

Figure 1:
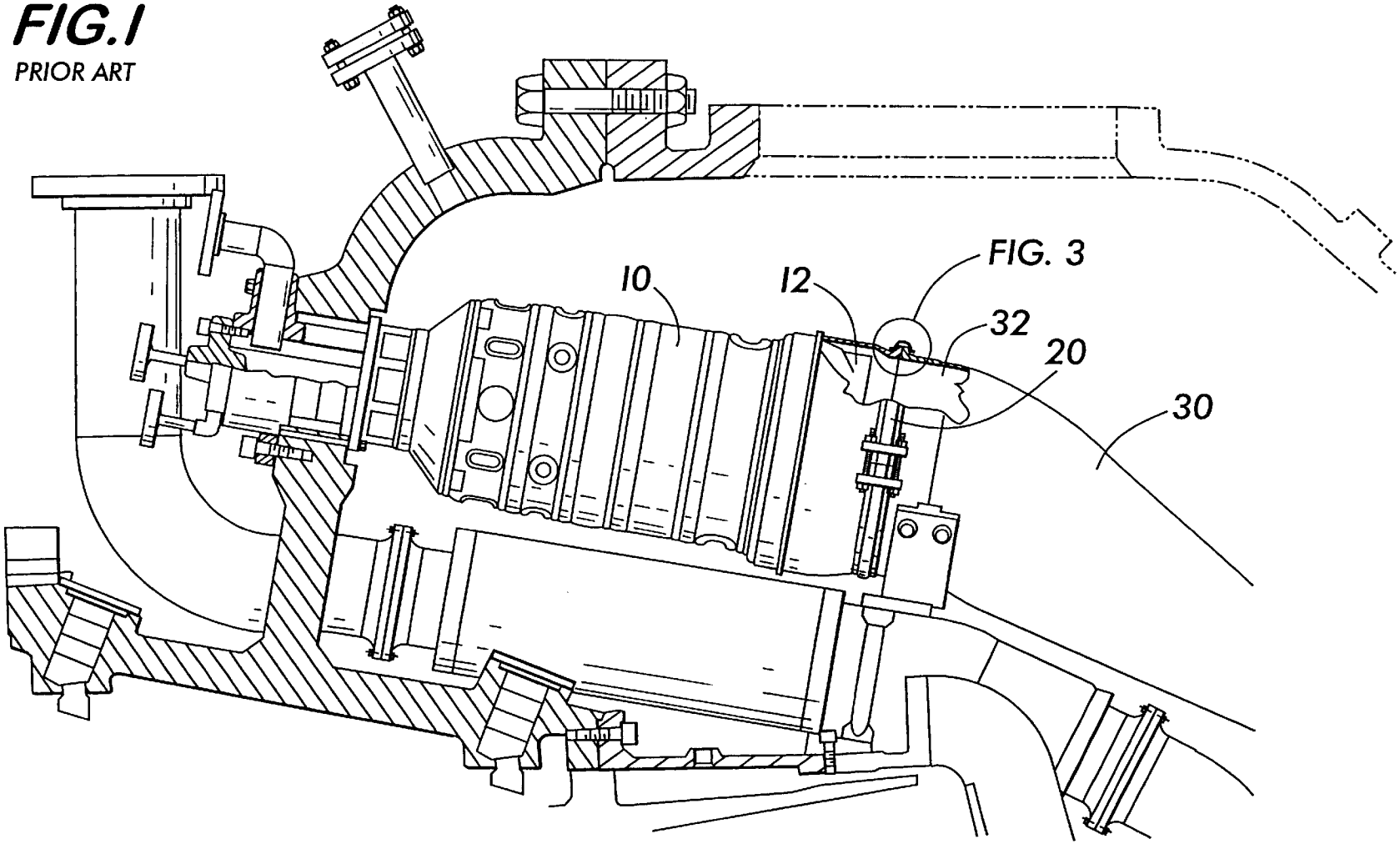
FIG. 1 PRIOR ART
FIG. 1 is a side view of a combustion section of a gas turbine, highlighting the area of concern to the present invention.
Figure 2:
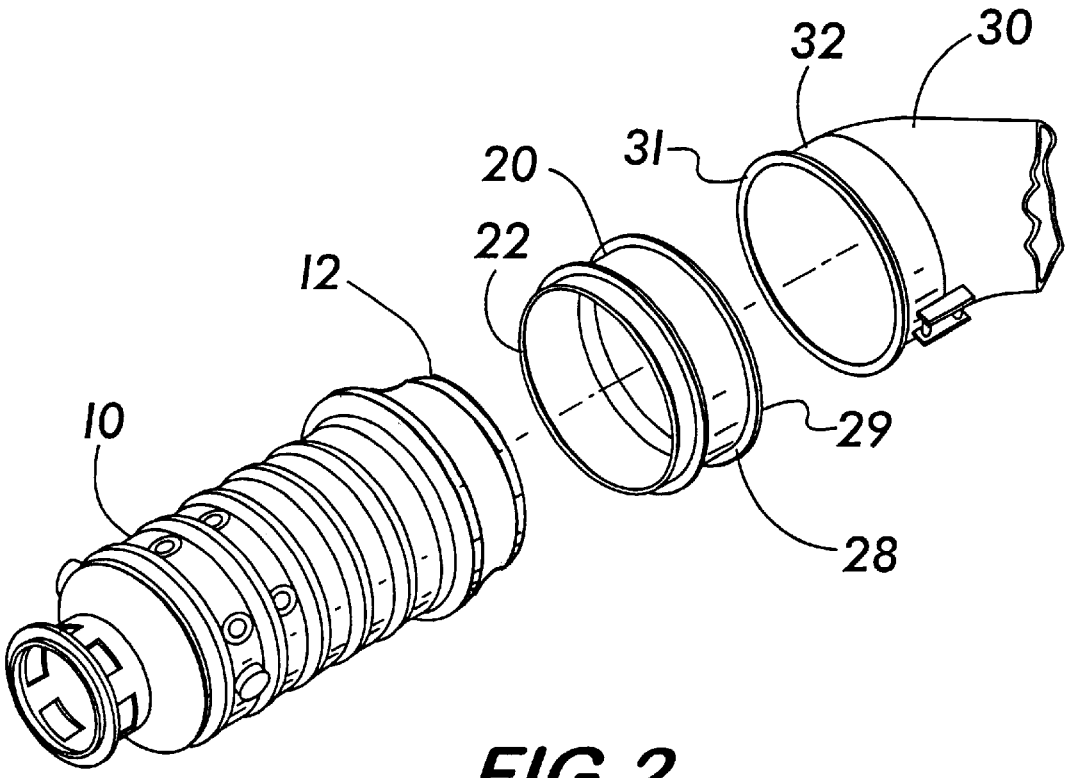
FIG.2 PRIOR ART
FIG. 2 is an exploded perspective view of a connection of a combustor basket to a transition.
Figure 3:
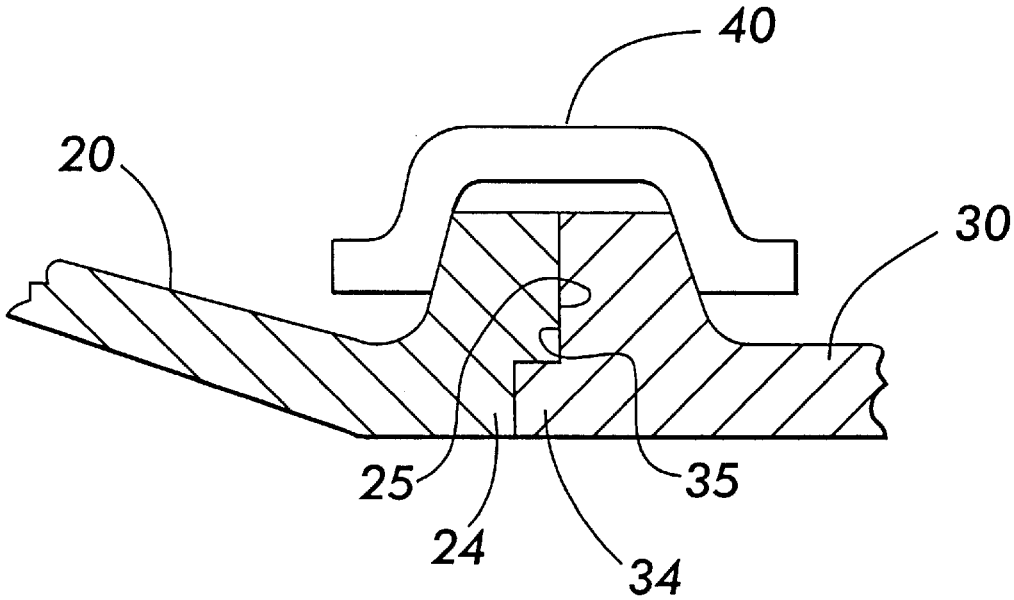
FIG.3 PRIOR ART
FIG. 3 is a partial, cross-sectional view of a conventional coupling apparatus according to the prior art.

In a preferred embodiment, the cylinder flange 29 further comprises a spigot lip 48 and the transition flange 31 further comprises a recess 52 for receiving the spigot lip 48 so as to effect a tight spigot fit when the cylinder flange 29 mates with the transition flange 31. Alternatively, as with the prior art as with the prior art as shown in FIG. 3, the transition flange 31 further comprises a spigot lip 48 while the cylinder flange 29 further comprises a recess 52. The present design, however, with the recess 52 on the transition flange 31, reduces the stresses on the coupling.

During turbine operation, the transition flange 31 gets hotter at a faster rate than the cylinder flange 29. Consequently, the transition flange 31 thermally expands faster than the cylinder flange 29. If the lip 48 expands faster than the recess 52, then more stresses are imposed on the coupling than if the recess 52 expanded more than lip 48. Accordingly, providing the recess 52 on the transition flange 31 is preferable. The spigot lip 48 and recess 52 extend 360 degrees about the periphery of the mating of the cylinder flange 29 and the transition flange 31.

The advantages of the coupling apparatus of the present invention are several, most of which are linked to the simplicity of its design. The primary advantage of the present coupling is that it effects a tighter fit than prior art devices. The clamping mechanism of the present invention, that of the locking mechanisms 60, acts in the axial direction and effects a uniform seal because of its spacing about the periphery of the mating of the flanges 29 and 31.

This arrangement provides for a more secure fit and a more robust coupling apparatus than conventional apparatus that is less sensitive to the vibration forces of the combustor and the turbulent conditions of the gas existing the combustor basket 10. As a result, the coupling apparatus of the present invention is less susceptible to fretting than prior art apparatus because there will be less of a tendency for parts to become loose. A more robust coupling is also less susceptible to the effects of fatigue and thereby, requires less servicing than conventional coupling apparatus.

Another improvement over the prior art lies in the orientation of the spigot lip 48 and the recess 52, i.e., providing the recess on the transition flange 31 as opposed to the cylinder flange 29. This orientation of the coupling apparatus of the present invention helps combat the effects of thermal expansion, yielding less stress on the coupling as the temperatures increase during turbine operation than prior art couplings.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A coupling apparatus for connecting a combustor to a transition in a gas turbine, the apparatus comprising:

(a) a transition cylinder defining an axial centerline thereof, said cylinder attached to a discharge end of the combustor, said cylinder comprising a downstream end, a cylinder flange formed on the downstream end and projecting radially outwardly and comprising a plurality of cylinder bores formed therein, the cylinder bores being axially oriented and circumferentially spaced about the cylinder flange;

(b) a transition comprising an upstream end, a transition flange which mates with the cylinder flange, the transition flange formed on the upstream end and comprising a plurality of transition bores formed therein, the transition bores being axially oriented and circumferentially spaced about the transition flange;

(c) a plurality of locking mechanisms for maintaining said transition cylinder in tight engagement with said transition when the cylinder flange mates with the transition flange, said locking mechanisms extending through an alignment of the cylinder bores and the transition bores; and (d) wherein the cylinder flange further comprises a spigot lip and the transition flange further comprises a recess to receive the spigot lip so as to effect a tight spigot fit when the cylinder flange mates with the transition flange in order to reduce transient thermal expansion stresses during operation.

2. The coupling apparatus of claim 1, wherein there are at least four locking mechanisms, at least four cylinder bores, and at least four transition bores, all equally spaced about the periphery of the mating of the cylinder flange and the transition flange.

3. The coupling apparatus of claim 1, wherein the locking mechanisms are nut and bolt combinations.

4. A method of connecting a combustor to a transition in a gas turbine, the method comprising the steps of:

(a) providing:

i) a transition cylinder defining an axial centerline thereof, said cylinder attached to a discharge end of the combustor, said cylinder comprising a downstream end a cylinder flange formed on the downstream end of said transition cylinder and projecting radially outwardly and comprising a plurality of cylinder bores formed therein, the cylinder bores being axially oriented and circumferentially spaced about the cylinder flange;

ii) a transition comprising an upstream end, a transition flange which mates with the cylinder flange, the transition flange formed on the upstream end and comprising a plurality of transition bores formed therein, the transition bores being axially oriented and circumferentially spaced about the transition flange, and iii) a plurality of locking mechanisms (b) mating the cylinder flange with the transition flange;

(c) aligning the cylinder bores and the transition bores;

(d) securing said plurality of locking mechanisms about the periphery of the mating of the cylinder flange and the transition flange so as to effect a tight engagement between said transition cylinder and said transition when said locking mechanisms extending through the alignment of the cylinder bores and the transition bores; and (e) wherein the cylinder flange further comprises a spigot lip and the transition flange further comprises a recess for receiving the spigot lip, and step (b) further comprises the step of aligning the cylinder flange with the transition flange so as to effect a spigot fit between the cylinder flange and the transition flange in order to reduce transient thermal expansion stresses during operation.

* * * * *